US005487251A

United States Patent [19]

Tolliver et al.

[11] Patent Number: 5,487,251

[45] Date of Patent: Jan. 30, 1996

[54] APPARATUS AND METHOD FOR REINFORCING CAST STRUCTURES

[75] Inventors: Wilbur E. Tolliver, Rockford; Larry R. Magnuson, Muskegon, both of Mich.

[73] Assignee: Independent Concrete Pipe, Mishiwaka, Ind.

[21] Appl. No.: 238,952

[22] Filed: May 6, 1994

[51] Int. Cl.[6] ..... E21D 11/10

[52] U.S. Cl. ..... 52/600; 52/649.1; 52/649.3; 52/649.8; 52/660; 52/662; 52/664; 52/722.1; 138/153; 138/175; 264/35; 405/124

[58] Field of Search ..... 52/649.1, 649.2, 52/649.3, 649.8, 600, 660, 730.2, 722, 624, 664; 405/239, 256, 257, 124, 125, 126; 138/175, 153; 264/333, 279.1, 35, 32, 228, 256

[56] References Cited

U.S. PATENT DOCUMENTS

| | | | |
|---|---|---|---|
| 342,280 | 5/1886 | Burdick . | |
| 912,318 | 2/1909 | McMahon | 138/175 X |
| 1,120,471 | 12/1914 | Franklin . | |
| 1,144,200 | 6/1915 | Hewett . | |
| 1,163,853 | 12/1915 | Randall et al. | 52/660 X |
| 1,254,153 | 1/1918 | Nelson | 264/35 X |
| 1,271,708 | 7/1918 | Horstman . | |
| 1,441,736 | 1/1923 | Metzsch . | |
| 1,443,162 | 1/1923 | Bent . | |
| 1,501,850 | 7/1924 | Karstens et al. | 138/175 |

(List continued on next page.)

FOREIGN PATENT DOCUMENTS

| | | | |
|---|---|---|---|
| 21340 | 5/1930 | Australia | 52/649.1 |
| 645343 | 7/1962 | Canada . | |
| 1385109 | 11/1964 | France | 52/649.3 |
| 2422782 | 12/1979 | France | 52/600 |
| 186041 | 7/1990 | Japan | 405/239 |
| 144073 | 6/1991 | Japan | 52/660 |
| 1004186 | 5/1964 | United Kingdom . | |
| 2100772 | 1/1983 | United Kingdom . | |
| 2124277 | 2/1984 | United Kingdom | 405/126 |

OTHER PUBLICATIONS

Exhibit A includes pp. 14–29 and 33 from the Mar. 1992 issue of National Underground Construction Association (NUCA) magazine, including articles disclosing various technologies concerning trenchless excavation construction methods, including jacking and related matters.

Exhibit B is an article entitled "NUCA Microtunnelling Pipe Standards Task Group, Concrete Pipe Section" published Feb. 23, 1993, which includes a specification for reinforced concrete pipe and discloses compressible bearing strips.

*Primary Examiner*—Carl Friedman
*Assistant Examiner*—Laura A. Saladino
*Attorney, Agent, or Firm*—Price, Heneveld, Cooper, DeWitt & Litton

[57] ABSTRACT

A rectangular reinforcing cage is provided for a cast concrete structure having longitudinal registration tubes at each corner of the cage. An outer reinforcing cage surrounds the registration tubes and a coaxial inner reinforcing cage is supported from the outer cage by a plurality of spacers. Each reinforcing cage has a pair of facing C-shaped mats having straight mats overlapping and connected to the bent ends of the "C" to complete each reinforcing cage. Each end of the C-shaped mats have a smoothly curved transition bend joining a portion perpendicular to the main portion of the mat. Each mat has a layer of longitudinal wires connected to a layer of transverse wires. The longitudinal wires being more closely spaced near the end of each mat than in the remainder of the mat with no longitudinal wires in the transition bend of each C-shaped mat. The longitudinal wires are positioned inside each C-shaped mat and outside each straight mat when a reinforcing cage is assembled. Each reinforcing cage including each mat and each C-shaped mat is shaped to close tolerances for producing consistent cast reinforced concrete structures. A jig for manufacturing the reinforcing cages is disclosed as well as the method for assembling the reinforcing cages and cast concrete structures including the reinforcing cages.

44 Claims, 6 Drawing Sheets

U.S. PATENT DOCUMENTS

| | | | |
|---|---|---|---|
| 1,554,767 | 9/1925 | Southern | 52/649.1 |
| 1,579,285 | 4/1926 | Danaher et al. . | |
| 1,670,625 | 5/1928 | Johannesson . | |
| 1,765,664 | 6/1930 | Flath . | |
| 1,774,664 | 9/1930 | Parmley . | |
| 1,950,343 | 3/1934 | White | 52/649.3 |
| 2,005,699 | 6/1935 | Gottwald . | |
| 2,042,132 | 5/1936 | Treskow . | |
| 2,488,245 | 11/1949 | Smith . | |
| 2,732,230 | 1/1956 | Risley et al. . | |
| 3,300,938 | 1/1967 | Schyndel et al. | 52/664 X |
| 3,333,388 | 8/1967 | Sandin . | |
| 3,402,559 | 9/1968 | Fukushima | 264/35 X |
| 3,419,047 | 12/1968 | Osweiler | 138/175 |
| 3,471,986 | 10/1969 | Swenson | 52/649.8 |
| 3,667,581 | 7/1972 | Breitfuss . | |
| 3,726,950 | 4/1973 | Turzillo | 264/333 X |
| 3,791,092 | 2/1974 | Schmitter | 52/600 |
| 4,026,582 | 5/1977 | Abe et al. . | |
| 4,047,388 | 9/1977 | Howlett . | |
| 4,070,848 | 1/1978 | Lingle . | |
| 4,117,872 | 10/1978 | Gott et al. . | |
| 4,199,158 | 4/1980 | de Munck . | |
| 4,496,259 | 1/1985 | Foucher . | |
| 4,497,590 | 4/1985 | Chase . | |
| 4,539,787 | 9/1985 | Ritter et al. | 52/664 |
| 4,606,671 | 8/1986 | Rasmussen . | |
| 4,667,452 | 5/1987 | Dick et al. | 52/649.1 |
| 4,689,867 | 9/1987 | Tolliver | 52/649.8 X |
| 4,693,635 | 9/1987 | Matiere | 405/126 X |
| 4,744,190 | 5/1988 | Couwenbergs et al. | 52/649.8 |
| 4,781,006 | 11/1988 | Haynes . | |
| 4,830,536 | 5/1989 | Birch et al. . | |
| 4,854,775 | 8/1989 | Lockwood | 405/124 X |
| 4,900,607 | 2/1990 | Glang et al. . | |
| 4,930,677 | 6/1990 | Jolliffee . | |
| 5,118,218 | 6/1992 | Musser et al. | 405/124 |

| NO. AND LOC. OF LONGITUDIONAL REINFORCING | | | | |
|---|---|---|---|---|
| PIPE I.D. | A | B | C | D |
| 6X6 | 10 | 97.5 | 11 | 102 |
| 6X5 | 8 | 85.5 | 9 | 90 |
| 6X4 | 6 | 73.5 | 7 | 78 |
| 6X3 | 4 | 71.5 | 5 | 66 |
| | | | | |

APPARATUS AND METHOD FOR REINFORCING CAST STRUCTURES

CROSS-REFERENCE TO RELATED APPLICATION

The apparatus and method of the present invention are particularly useful in, though not limited to, manufacturing reinforcing cages for precast concrete pipe and precast concrete structures as disclosed in U.S. patent application Ser. No. 08/239,342 filed May 6, 1994 (filed simultaneously with the present application) entitled APPARATUS AND METHOD FOR MANUFACTURING PRECAST STRUCTURAL PRODUCTS. The inventors of the application are Wilbur E. Tolliver and Larry R. Magnuson, the same inventors as the present application. The content of that application is incorporated herein, in its entirety, by reference.

BACKGROUND OF THE INVENTION

The present invention relates to apparatus and methods for preparing the reinforcing steel for precast or cast in place reinforced concrete structures and shapes, although the present invention is not intended to be limited only to concrete structures. Representative examples of precast concrete structures are concrete pipes, boxes, tanks, containers, building structures and rooms, i.e., apartment and motel rooms as well as jail cells and basements. In order to simplify the description, reinforced precast concrete box pipe will be used as the concrete shape being manufactured in view of its similarity to many of the straight-sided structures.

In the usual method of manufacturing precast concrete box pipe, reinforcing mats produced from welded wire fabric or Rebar (rod) are joined together to make reinforcing cages to be used as the reinforcement structure for the precast concrete box pipes. Little care has been taken in the cutting, bending and positioning of the rod or wire fabric mats used in making the reinforcing cages. When wire fabric mats are used, it is difficult to bend the fabric at a right angle at the precise distance from the ends of the fabric mat to position the primary reinforcing steel at its designated location in the top or bottom slabs of the concrete box pipe. This is difficult because the wires perpendicular to the primary reinforcing wires are not positioned to yield precise location of the bend. Also, when multiple layers of reinforcing cages are used, the positioning and separation of these cages are not carefully controlled. The cages produced from the mats are allowed to bow inwardly and outwardly within the surface boundaries of the concrete pipe which makes their spacing relative to the surfaces of the concrete structure difficult to maintain. The assumption is usually made that when the concrete is poured, any mistakes will be covered and the concrete structure is strong enough anyway so that it really does not make a difference if the reinforcing is precisely located.

The overall result of all of the above thinking is inconsistent spacing of the reinforcing within the pipe structure and sections of box pipe are cast with varying strengths and load bearing abilities.

SUMMARY OF THE INVENTION

A reinforcing cage for a cast concrete structure having end surfaces includes a plurality of spaced locators defining an extremity of each end surface of the cage. The reinforcing cage further includes an outer reinforcing cage, an inner reinforcing cage spaced from the outer cage, and at least one spacer member located between the inner and outer reinforcing cages and attached to the inner and outer reinforcing cages. The locators are attached to one of the outer reinforcing cage, the inner reinforcing cage, and the spacer member.

A method of manufacturing reinforcing cages for cast structural units includes positioning a plurality of spaced longitudinal tubes having tubular end sections on a jig including locator pins for engaging the tubular end sections, providing a matrix of shaped reinforcement wires, and securing the matrix of wires to the tubes to form a reinforcing cage, the tubes forming a locating system on the reinforcing cage.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
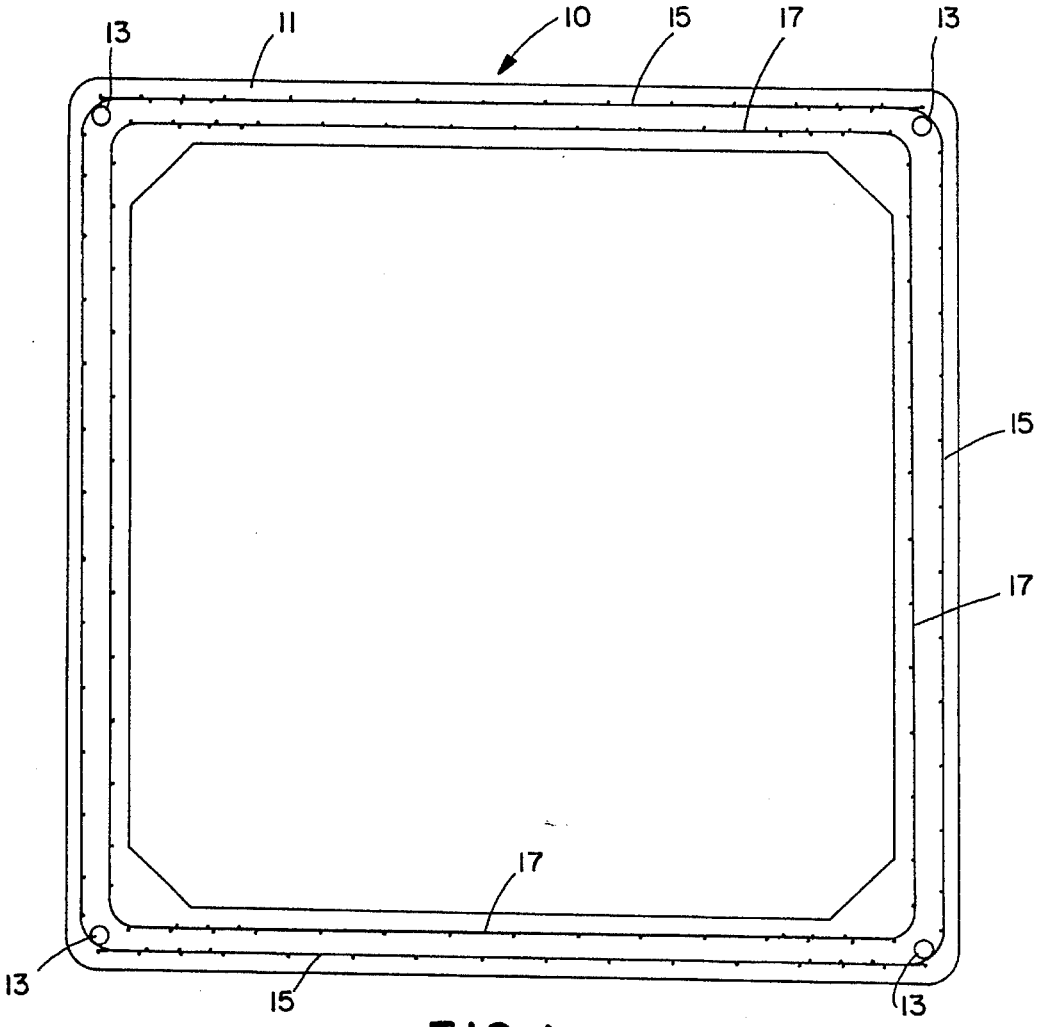
FIG. 1 is a schematic plan view of a reinforcing cage in place in a section of concrete pipe.

In accordance with the preferred embodiment, cages are preferably manufactured using welded wire fabric reinforcing mats but can be manufactured from Rebar pieces that are secured together to make the reinforcing cages. When multiple reinforcing cages are used, the reinforcing cages are preferably assembled from fabric mats so that one cage will be positioned near the inner surface of the pipe and the other near the outer surface. The reinforcing cages have two facing C-shaped mats joined by overlapping straight mats. The C-shaped mats are straight prior to being bent into a C-shape. Each C-shaped mat has an elongated central portion bounded at each end by a short portion perpendicular to the central portion. Precisely formed transition bends join the two end portions of the mat to the central portion. The longitudinal wires of the central portion of the reinforcing mats, just prior to the transition bends, are precisely located in the mat to allow the bent transverse wires of the C-shaped mats to be positioned in the top and bottom slabs of the box pipe at the specified locations.

Both the curved and straight mats have longitudinal and transverse layers of wires. The longitudinal layer of wires' prime purpose is to hold the transverse wires at their proper spacing and to stabilize the wire fabric mat for handling. The spacing of the longitudinal wires in the straight sections is closer at each end than it is in the central portion of the mat. The same is true with regard to each C-shaped mat; however, a further limitation is made in that there are no longitudinal wires in the space on the C-shaped mat where the transition bend is formed. Also, the longitudinal wires used with each C-shaped mat are internal to the "C" shape while the longitudinal wires used with the straight mats are external to the mats so that they do not interfere when the ends of the mats overlap in assembling the reinforcing cages. This feature allows the transverse reinforcing wires of the C-shaped and straight mats to be nested, in the same general location among the longitudinal wires in the mats within the box pipe top and bottom slabs. The resulting reinforcing cage has a substantially continuous circumferential reinforcing layer of transverse wires.

In the assembly of the reinforcing structure, it is preferred to use an outer and an inner reinforcing cage. The reinforcing cages are produced by joining together, preferably by welding or wire tying, the C-shaped and straight fabric mats at their lapped intersects. Each reinforcing structure is substantially identical with an inner cage fitting within the confines of an outer cage and with the inner cage located at a specified location near the inner surface of the box pipe walls. It is preferred that each outer reinforcing cage be assembled about and attached to longitudinal registration tubes that are precisely positioned near the outer corners of the box pipe reinforcing structure. Cage separator members can be used to precisely position the inner and outer reinforcing cages, relative to one another, within the walls of the concrete box pipe structure. One or more reinforcing cage separator members can be used per box wall to provide proper spacing between the cages and to prevent movement or bowing of the cages within the walls. Each of the cages and cage separator members which make up a reinforcing structure are joined together, preferably by welding or wire tying, so that a one-piece structure is assembled. Each step is carefully repeated in the manufacture of additional reinforcing cage structures so that every section of concrete box pipe manufactured will have known strengths and load bearing capabilities.

Referring to FIG. 1, a section of concrete pipe is indicated generally by the number 10. The box pipe shown is representative of a 6 by 6 foot section with a 6 foot span and a 6 foot rise. Schematically illustrated in FIG. 1 are other box pipes with rises of 3, 4 and 5 feet.

The concrete pipe has a cast concrete wall 11 which is approximately six inches thick along the top, bottom and sides and approximately 12 inches thick at the corners or haunches of the box pipe structure. A longitudinal registration tube 13 having end sections with open ends forming locators adapted to accurately orient and locate the reinforcing structure in a casting jig is preferably positioned in each corner of the box pipe. On each side of the registration tubes are a pair of concentric reinforcing cages 15 and 17. Registration tubes 13, along with cages or matrix 15 and 17, are preferably all joined together by welding or tying to form a unitary reinforcing structure for the concrete box pipe.

Figures 2, 4:
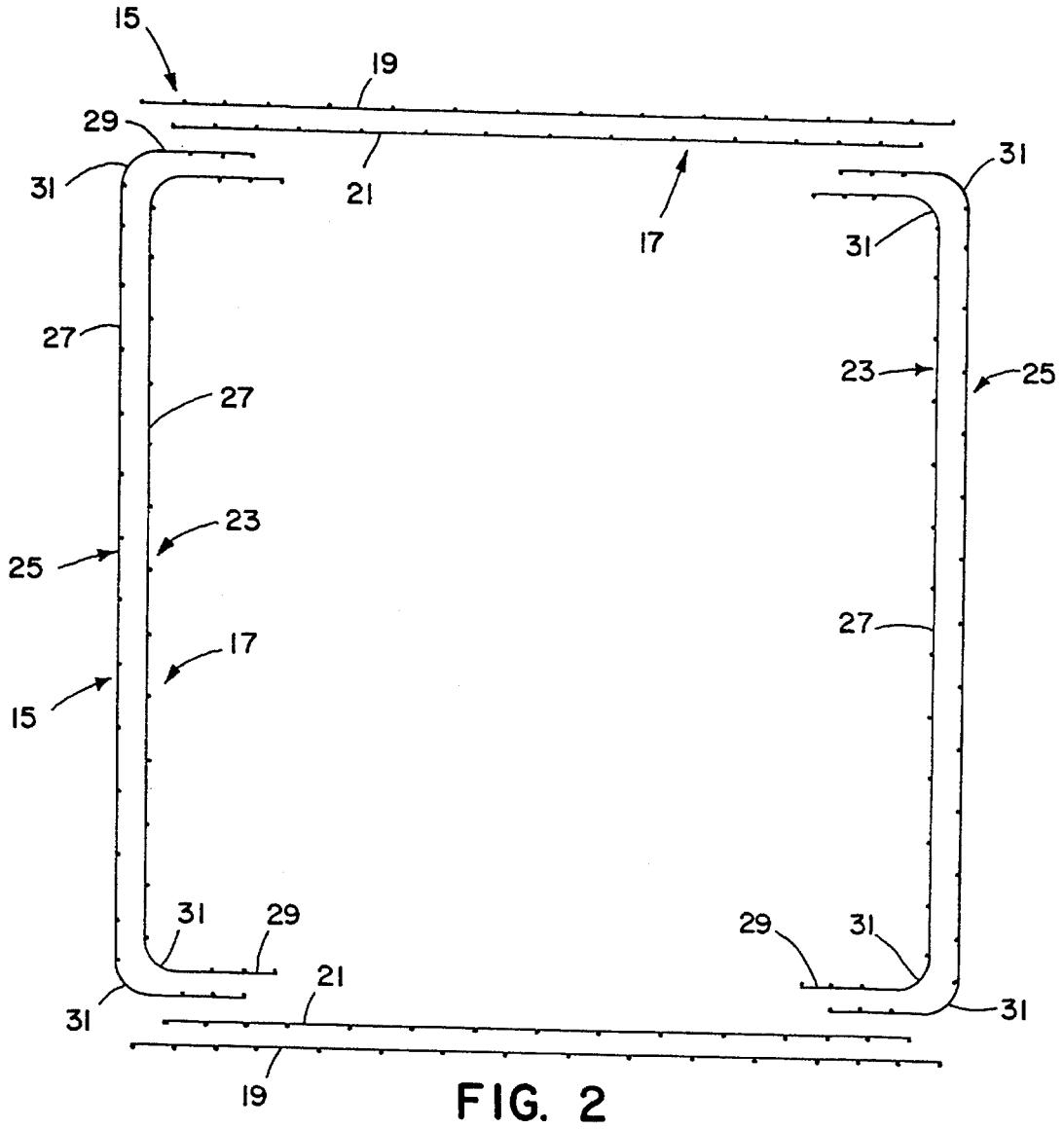
FIG. 2 is an exploded plan view showing the positioning and configuration of the mats used in the reinforcing cage.
FIG. 4 is a chart showing typical mat lengths and longitudinal wire spacing in the central portion of each mat.

As shown in FIG. 2, outer cage 15 and inner cage 17 are each assembled from straight mats 19 and 21 and C-shaped mats 23 and 25. Each of the cages is made up of two joined layers of transverse reinforcing wires; one layer is in the C-shaped mats and one layer is in the straight mats. A fragmentary view of a reinforcing mat is shown in FIG. 3A. The transverse steel wires in each mat are preferably 3/16 to 7/16 of an inch in diameter and the longitudinal steel wires are substantially smaller and are preferably 1/8 to 3/8 of an inch in diameter.

It can be seen from an examination of FIGS. 1 and 2 that each of the mats making up the reinforcing cages has a particular pattern of longitudinal wires with the longitudinal wires in straight sections 19 and 21 being positioned toward the outside of the pipe while the longitudinal wires in the bent C-shaped sections are positioned toward the inside of the pipe.

Each of the C-shaped mat sections of the pipe reinforcing cage has an elongated central portion 27 joined to a substantially perpendicular portion 29 by a transition bend 31. Each transition bend 31 is substantially identical and is precisely located relative to the longitudinal wires in the C-shaped mat. Each transverse wire of the mat is bent to precisely the same radius, approximately three inches. It should be noted in FIG. 2 that there are no longitudinal reinforcing wires in the transition bend regions.

The length of the C-shaped sections of each reinforcing cage is preferably determined by the rise of the box pipe with the C-shaped reinforcing mats being used in the sidewalls of the pipe. The straight reinforcing mats of each reinforcing cage cover the span of the pipe or the load bearing portion of the pipe. It is within the scope of the present invention to use the C-shaped mats on the span of the concrete box pipe and with the straight mats on the sides. Also, with a square concrete box pipe, the location of the particular mats can be immaterial if each side of the pipe has the same strength.

Referring to FIG. 2, ben portions 29 at each end of C-shaped sections 23 and 25 function as positioning and anchoring devices for straight reinforcing mats 19 and 21. Bent end portions 29 are kept short since they do not add materially to the reinforcement of the pipe. The inner and outer reinforcement cages can have different size transverse wires in the mats to meet particular design specifications. The inner of the two straight mats, mat 21, is usually the stronger of the two since it is under the greatest tension when the surface of the pipe is under load, for example from soil or passing vehicles. Steel reinforcing mat 21 is positioned close to the inner surface of the concrete box pipe as that is where the greatest tension is on the concrete and where the concrete needs to be reinforced since concrete is about ten times stronger in compression than in tension.

Figure 3:
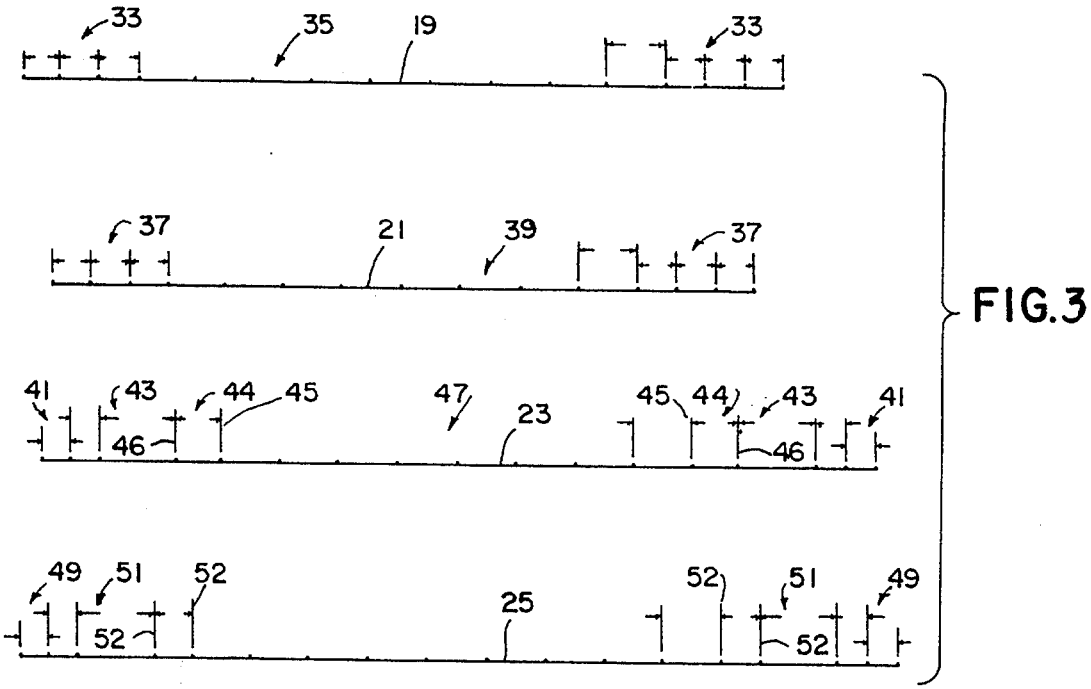
FIG. 3 is a diagrammatic view of the reinforcing mats showing the spacing between the longitudinal wires in each mat.
Figure 3A:
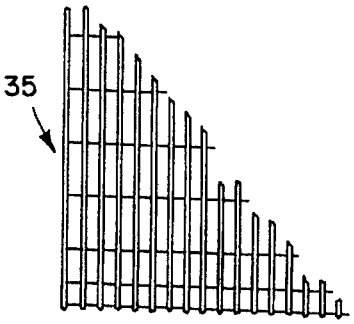
FIG. 3A is a schematic plan view showing the reinforcing mat of FIG. 3.

Now referring to FIG. 3, mat 19 can be seen to have four closely spaced longitudinal wires in first zone 33 at each end of mat. The wires in zone 33 are spaced approximately four inches from each other. These wires overlap the wires at each end of the C-shaped mats. The central zone 35 of the mat has 8 longitudinal wires, each of which is spaced approximately 6 inches apart. For a 6 by 5 concrete box pipe, mat 19 would be approximately 78 inches long. Mat 21 has three closely spaced longitudinal wires in first zone 37 at each end of the mat which are approximately four inches apart. The central zone 39 of the mat has 7 longitudinal wires, each spaced approximately six inches apart providing a mat of approximately 72 inches. Mat 23, which is to be bent to form a C-shaped mat, has three longitudinal wires in a first zone 41 at each end which are spaced approximately three inches apart. Moving inwardly toward the center of the mat there is a second zone 43 approximately eight inches in length for the transition bend 31. There are no longitudinal wires in the second zone so that no longitudinal wires are included in the transition bend. Moving inwardly, a third zone 44 is defined by wire 45 which is spaced approximately four and three-quarter inches from the last wire of the second zone. The third zone can be of random length determined by the overall length of the mat, the position of the second zone and the spacing between the wires in the fourth or central zone 47 of the mat. Wires 46, at each end of the second zone, are the key wires in forming each C-shaped mat. Wires 46 determine the length of the straight portion of the C-shaped mat and the overall length of the mat in the pipe reinforcing structure. If the spacing between wires 45 and 46 is the same as the spacing between the longitudinal wires in the fourth or central zone of the mat, then the third zone will define a uniform pattern with the fourth zone. If the spacing between wires 45 and 46 is not the same as the spacing between the wires in the fourth or central zone, then zone three will define a non-uniform pattern. Seven longitudinal wires 47 are positioned approximately four inches apart in the fourth zone, giving an overall mat length of approximately 85.5 inches. Mat 25 has three longitudinal wires in the first zones 49 at each end of this mat which are spaced approximately three inches from each other. A second zone 51 is provided which is approximately eight inches long which is terminated by key wires 52. This is followed, moving inwardly toward the center of the mat, by a longitudinal wire 53 spaced approximately four inches from the transition portion 51. The third zones of the mat are bounded by wires 52 and 53. The fourth zone 54, or center portion of the mat, is made up of eight longitudinal wires spaced approximately nine inches apart for an overall length of 90 inches. This mat is bent in the transition or second zone 51 so that the longitudinal wires are within the "C" and no longitudinal wires are located in the transition bend zone.

In assembling the reinforcing cage by wire tying with steel wire, it is preferred that the spacing of the wires in the end zones of the C-shaped and straight mats be the same so that the longitudinal wires can be overlapped shortening the length of the lap and wire tie used. If the cage is assembled by welding, the wires in each mat can be spaced differently.

In FIG. 4 a table is presented showing the number and location of the longitudinal reinforcing wires for four pipes having a 6 foot span and rises of 3, 4, 5 and 6 feet. In the 6 by 5 pipe, which corresponds to the dimensions of FIG. 3, mat 23 has eight spaces bounded by reinforcing rods spaced six inches apart for an overall mat length of 85.5 inches, before bending. Mat 25 has nine places bounded by longitudinal reinforcing rods spaced six inches apart for an overall mat length of 90 inches. Specifically in the table of FIG. 4, for each size pipe, its inner C-shaped reinforcement mat has a number of spaces "A" and length "B", and its outer C-shaped reinforcement mat has a number of spaces "C" and length "D". The number and spacing of the longitudinal reinforcing wires can be changed for larger and smaller box pipes with the same six foot span using the data of FIG. 4.

Figure 5:
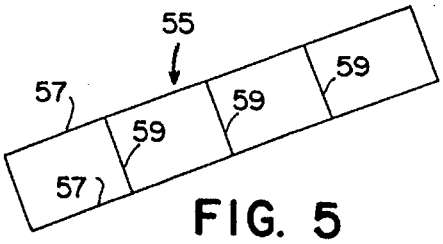
FIG. 5 is a perspective view of the preferred material used to form the spacers.
Figure 8:
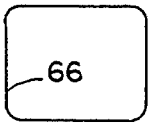
FIG. 8 is a schematic rectangular spacer configuration.
Figure 7:
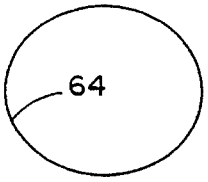
FIG. 7 is a schematic circular spacer configuration.
Figure 6:
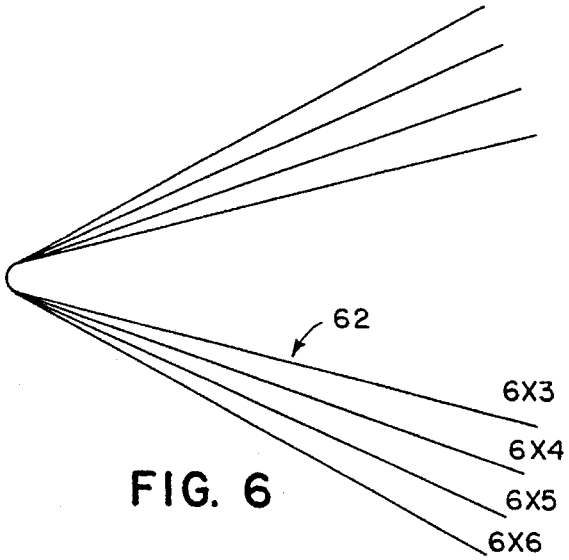
FIG. 6 is a diagrammatic view showing A-shaped spacers for a reinforcing mat.

In order to control the separation or distance between the concentric reinforcing cages, a ladder-type separator 55 (FIG. 5) is used having elongated runners 57 separated by transverse cross members 59. The ladder is the preferred configuration for the cage separator members. Also, the ladder is preferably cut adjacent to a transverse wire so that there are no projecting end portions which could injure a worker assembling the reinforcing cages. Separator member 55 can be bent into an A-type or angular configuration 62, as shown in FIG. 6, with the spread of the "A," or the width of the area enclosed by the "A," being proportional to the size of the pipe being manufactured. Also, a circular configuration 64 can be prepared for the separator member, as shown in FIG. 7. Again, the diameter of the circle would be proportional to the size of the pipe being prepared. A rectangular separator configuration 66 (FIG. 8) can also be prepared, again with the size of the rectangle being proportional to the size of the pipe being manufactured. The angular configuration, the circle and the rectangle are preferred configurations for the separators. Other separator configurations and types can also be used and are clearly within the scope of the present invention. Also, multiple separators, of the same or different shapes including discrete individual separators, can be used between the reinforcing cages.

Figure 9:
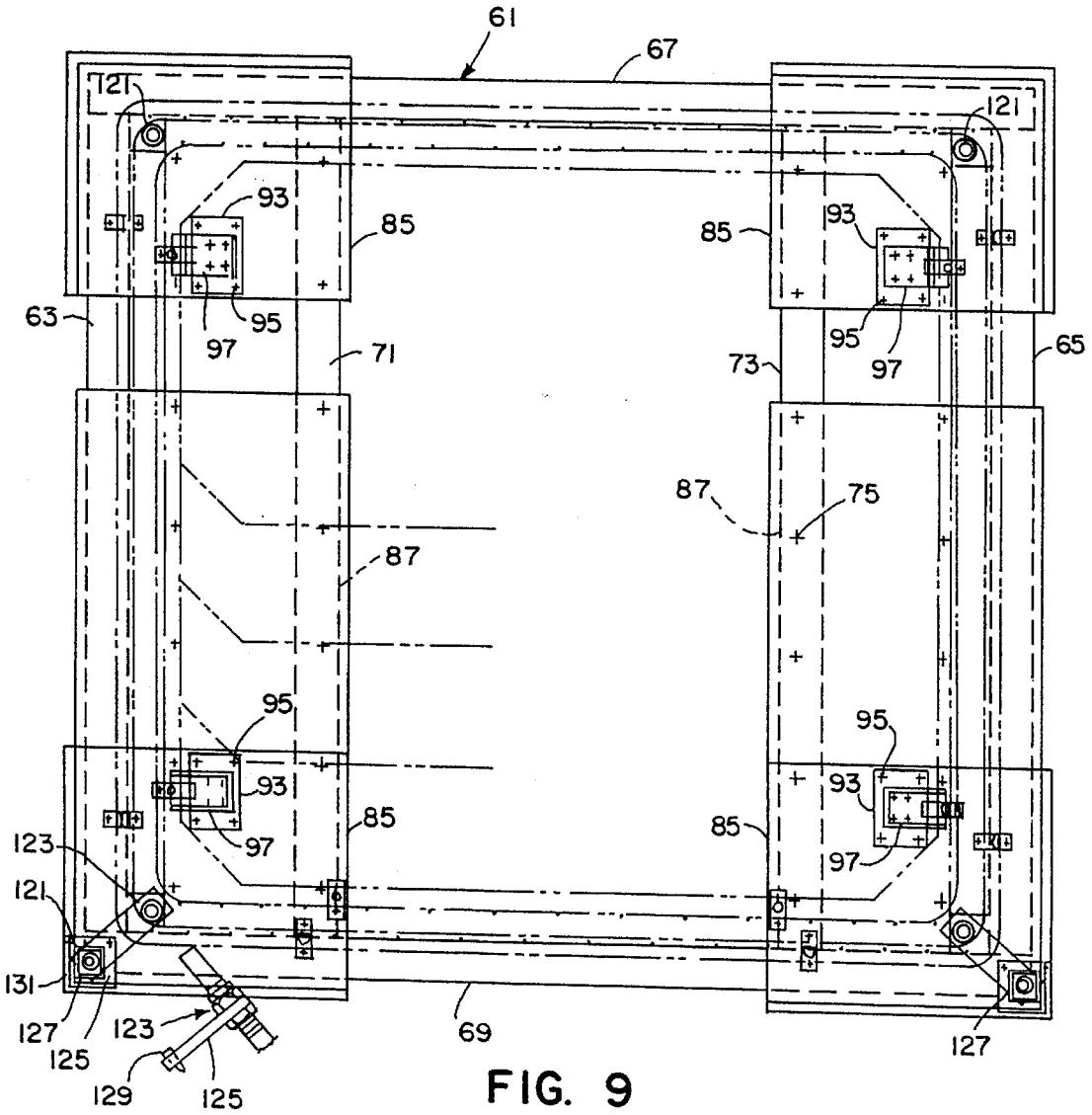
FIG. 9 is a plan view of a jig which can be used in the assembly of a reinforcing cage.

In the preferred method of assembling the reinforcing cages (FIGS. 9–12), a jig 60 is used to hold the reinforcing mats in position while inside cage 17 and outside cage 15 are assembled. Jig 60 (FIG. 9) has a substantially rectangular base frame 61 which includes side members 63 and 65 which are connected together by end members 67 and 69. A pair of internal frame members 71 and 73, each equipped with a plurality of spaced mounting points 75, indicated by + signs, are mounted between the end members 67 and 69. The internal frame members 71 and 73 enable the frame to be adjusted for the manufacture of reinforcing structures for pipes with the same span but different rises. The base of the jig is preferably assembled from steel tubing which can be welded or bolted together. For large reinforcing cages it is preferred to bolt the several pieces together so that the frame can be disassembled and reassembled for movement to different manufacturing locations.

A support plate 85 is positioned at each corner of base frame 61. In order to facilitate the changing in size of the base frame, a fastener plate 87 (FIG. 9) is mounted under support plates 85. Fastener plates 87 extend across both side members 63 and 65 and internal members 71 and 73 and can be connected to these members by fasteners (not shown). A steel plate (not shown) of the same thickness as fastener plates 87 is preferably positioned under each support plate 85 supported on end member 67. The latter steel plate positions each support plate 85 at the same height relative to base frame 61.

Figure 10:
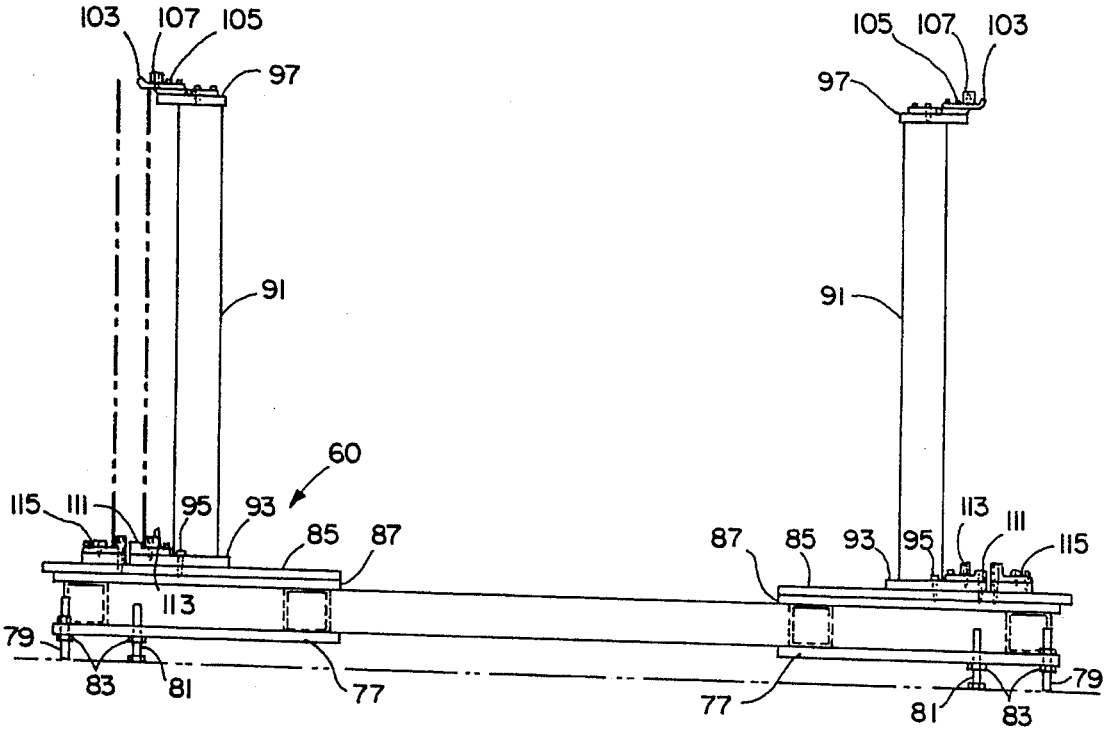
FIG. 10 is a side elevational view of the jig of FIG. 9.
Figure 11:
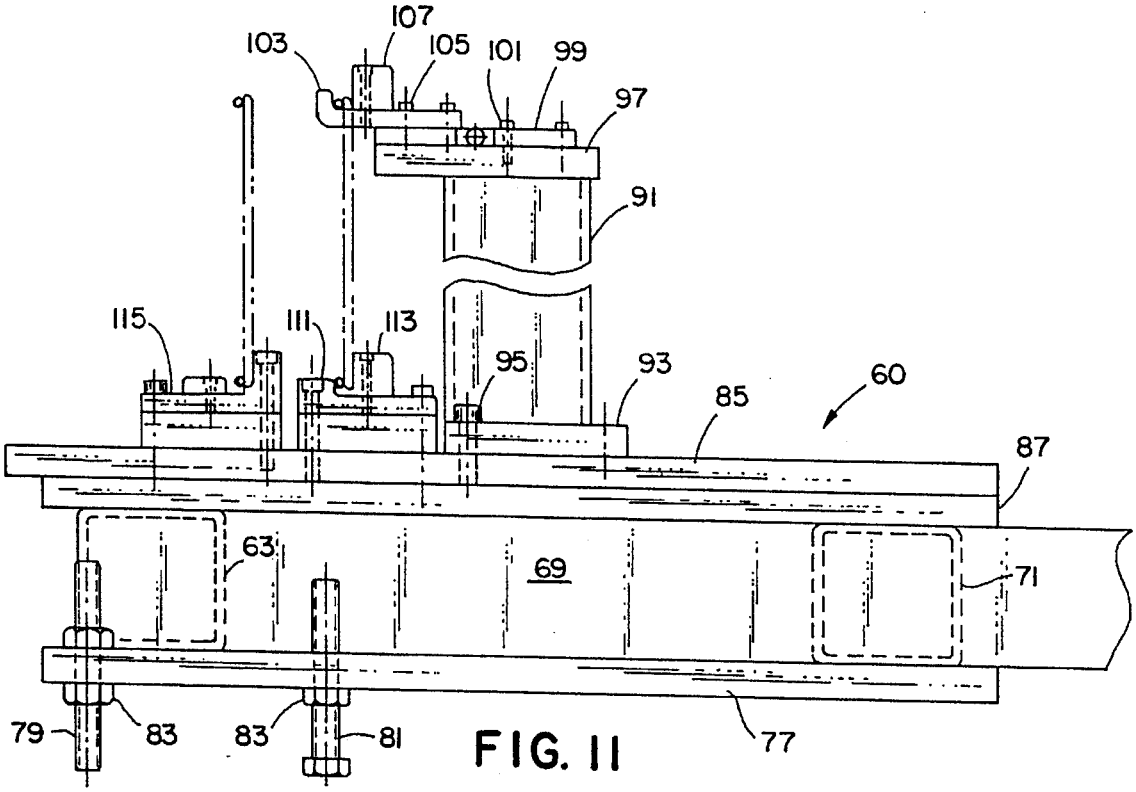
FIG. 11 is an enlarged, fragmentary view of an upper and lower reinforcement mat holder on the assembly jig.
Figure 12:
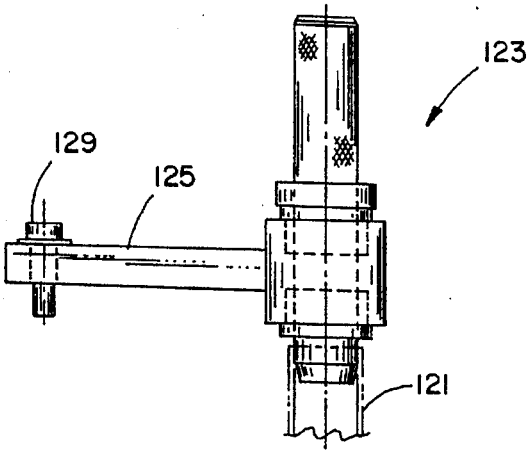
FIG. 12 is an elevational view, partially in section, of the movable upper holder for the threaded tubes in the reinforcing cages.

A stand 91 is supported by a flange 93 on each support plate 85 (FIGS. 10 and 11). Each flange 93 is fastened to a support plate 85 by a suitable threaded fastener 95. A cap plate 97 is mounted on the top of each stand 91. Each cap plate 97 has a hook support member 99 mounted on the top by threaded fasteners 101. An upwardly turned hook 103 is attached to each hook support member 99 by suitable threaded fasteners 105. Hook 103 supports each C-shaped reinforcing mat by the top transverse wire. Since the transverse reinforcing wires are not always the same size for every mat, an adjustable positioning block 107 is attached to the upper surface of each hook 103. Positioning block 107 can be moved to provide space for various size transverse wires. The reinforcing mat is held between the faces of the hook and the positioning block which cause the mat to hang at the proper angle for assembly into the reinforcing cages.

A bottom mat holder 111 is mounted on support plate 85 below hook member 103. An adjustable positioning block 113 is provided for different size transverse wires in the reinforcing mats. Hooks 103 and bottom mat holders 111 hold each inner C-shaped member 23 in position for assembly into a reinforcing cage. A second bottom mat holder 115 is mounted on support plate 85 outside of bottom mat holder 111 to hold outer C-shaped section 25 in position during the assembly of the reinforcing cage. An upper support hook is not necessary for outer C-shaped mat 25 since it is supported from the bottom and attached to the separators (not shown) between reinforcing mats 23 and 25.

When jig 60 is used to assemble reinforcing cages for use in manufacturing shear bolt connected pipe sections, as disclosed in previously mentioned co-pending patent application Ser. No. 07/842,086, threaded tubes 121 (FIG. 9) including internally threaded end sections are supported at each remote corner of the jig. An upright guide member (not shown) can hold the bottom of the threaded tubes 121 while the tops of the tubes are held by a spring loaded holder 123 (FIGS. 9 and 12), mounted on swiveled arms 125, mounted on the top of support posts 127 by fastener 129. Support posts 127 are attached to flanges 131 mounted in each remote corner of support plates 85. Support posts 127 should preferably be slightly longer than threaded tubes 121 to enable upper holder 123 to swing over the end of the threaded tube.

In the preferred method of assembling the reinforcing cages, inner C-shaped reinforcing mats 23 are suspended from hooks 103 at the top and are held at the bottom by bottom mat holders 111. Each C-shaped reinforcing mat preferably covers the side or rise of the concrete pipe. The straight reinforcing mats 19 and 21 cover the span or top and bottom of the pipe.

When the reinforcing cage is assembled, the position of the straight mats in the top or bottom layer of concrete can be determined by the position of the transition bends 31 relative to key wires 46 in C-shaped mat 23 and key wires 52 in C-shaped mats 25. Using mat 23 as an example, straight mat 21 can be positioned closer to the inside of the concrete pipe, where the greatest tension is present when the pipe is under load, by forming the transition bend close to key longitudinal wire 46. The position of mat 21 can be controllably moved within the width of the top and bottom layer of concrete by moving the transition bend relative to key longitudinal wire 46. Mat 25 can be similarly bent to control the position of straight mat 19 in the layer of concrete forming the top and bottom of the pipe. If, for some design reason, it is desired to have the straight reinforcing mats in different positions in the top and bottom of the pipe, this can be done by making the transition bends at different locations at each end of the C-shaped mats. It is preferred to control transition bend 31 in C-shaped mats 23 and 25 to position straight mat 21 closer to the inside surface of the pipe and straight mat 19 closer to the inside surface of the pipe and straight mat 19 closer to the outside surface of the layer of concrete.

Three methods can be used to shift the end or locating portions of the C-shaped mats and, in turn, the location of the straight mats in the concrete wall of the box pipe. The first and preferred method, described above, shifts the location of the transition bend in the wide zone free of longitudinal wires. This technique allows the same design mat to be used for different concrete cover thicknesses.

The second method shifts the location of the key wires relative to the end of the mat with the transition bend being made in a space free of longitudinal wires adjacent each key wire.

The third method maintains a constant distance from the end of the mat to each key wire and changes the length of the central or middle zone of the mat and, in turn, the overall length of the mat.

The second and third methods require that the reinforcing mat be specifically designed for each reinforcing cage and concrete structure. In all three methods, it is preferred that the reinforcing mats be cut or manufactured with little or no overhang or extending wire ends that can be a potential source of injury to personnel.

The reinforcing cages can be assembled either with or without the threaded tubes in the corners. C-shaped mats 23, with predetermined bends 31 for positioning the straight mats, are suspended from hooks 103 and held at the bottom by holders 111. Straight mats 21 are then positioned so that they overlap the longitudinal wires in first zone 41 of C-shaped mat 23. The wires near each end of the C-shaped mat add very little strength to the reinforcement cage and are therefore maintained relatively short. The longitudinal wires on the C-shaped mats are within the "C" shape while the longitudinal wires in the straight mats are on the outside. This enables the transverse heavier steel wires to be nested without interference from the longitudinal wires on each mat. After each end of the straight and C-shaped mats have been properly positioned, the mats can be joined together by welding or by tying with steel wire. The transverse reinforcing wires at the ends of the mats are interwoven to form a substantially continuous circumferential reinforcing structure.

After the inner reinforcing cage is assembled, the threaded tubes, if used, are positioned and held on the jig so that they can be welded or tied to the outer cage. The separator members are attached by welding or tying on the outside surface of the inner cage. One or more separators of the same or different configuration can be used.

Outer C-shaped mats 25 are then positioned in bottom mat holders 115 and are attached to the separators and threaded tubes, if used, by welding or tying. Outer straight reinforcing mats 19 are then overlapped and nested in the first zone of each C-shaped mat and joined by welding or tying. The reinforcing cage is now complete and can be lifted from jig 60 as a unitary assembly for incorporation into a precast concrete structure. When a reinforcing structure is assembled without the longitudinal threaded tubes in each corner, spacers should be used to position the reinforcing structure in the concrete. The spacers can be attached to the reinforcing structure and be positioned so that they extend outwardly to contact the inner surface of the form into which the concrete is to be added. The spacers position the reinforcing cage in the concrete structure.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows.

1. A reinforcing cage for a cast concrete structure having end surfaces, comprising:

a plurality of spaced locators defining the extremity of each end surface of said cage;

an outer reinforcing cage;

an inner reinforcing cage spaced from said outer cage; and at least one spacer member between each of said reinforcing cages, said spacer member being attached to said outer and inner reinforcing cages, said plurality of spaced locators being attached to only one of said outer reinforcing cage, said inner reinforcing cage, and said at least one spacer member.

2. A reinforcing cage for a cast concrete structure as set forth in claim 1, including a plurality of spaced longitudinal tubes having ends defining said plurality of spaced locators.

3. A reinforcing cage for a cast concrete structure as set forth in claim 2 wherein said outer reinforcing cage is attached to an outside of said longitudinal tubes.

4. A reinforcing cage as set forth in claim 1 wherein said plurality of spaced locators are located within a space defined between the inner and outer reinforcing cages.

5. A reinforcing cage for a cast concrete structure having end surfaces, comprising:

a plurality of spaced locators defining the extremity of each end surface of said cage;

an outer reinforcing cage;

an inner reinforcing cage spaced from said outer cage; and at least one spacer member between each of said reinforcing cages, said spacer member being attached to said outer and inner reinforcing cage, said plurality of spaced locators being attached to only one of said outer reinforcing cage and said inner reinforcing cage.

6. A reinforcing cage for a cast concrete structure having end surfaces, comprising:

a plurality of spaced locators defining the extremity of each end surface of said cage;

an outer reinforcing cage;

an inner reinforcing cage spaced from said outer cage;

at least one spacer member between each of said reinforcing cages, said spacer member being attached to said outer and inner reinforcing cages, said plurality of spaced locators being attached to one of said outer reinforcing cage, said inner reinforcing cage, and said at least one spacer member;

a plurality of spaced longitudinal tubes having ends defining said plurality of spaced locators, said outer reinforcing cage being attached to an outside of said longitudinal tubes; and said outer reinforcing cage including two first C-shaped members joined by overlapped first straight members and said inner reinforcing cage including two second C-shaped members joined by overlapped second straight members.

7. A reinforcing cage for a cast concrete structure as set forth in claim 6 wherein said outer reinforcing cage and said inner reinforcing cage each comprise sections of C-shaped and straight reinforcing mats made of transverse layers of spaced steel wire.

8. A reinforcing cage for a cast concrete structure as set forth in claim 7 wherein each of said reinforcing mats has a plurality of longitudinal and transverse reinforcing wires with the longitudinal reinforcing wires being more closely spaced near each end of a mat than they are near the center of a mat.

9. A reinforcing cage for a cast concrete structure as set forth in claim 8 wherein the longitudinal reinforcing wires are on the inside of each C-shaped member when assembled in the reinforcing cage.

10. A reinforcing cage for a cast concrete structure as set forth in claim 8 wherein the longitudinal reinforcing wires are on the outside of each straight member when assembled in the reinforcing cage.

11. A reinforcing cage for a cast concrete structure as set forth in claim 7 wherein each of said reinforcing mats include a first layer of spaced wires attached to a second layer of orthogonal spaced wires.

12. A reinforcing cage for a cast concrete structure as set forth in claim 8 wherein the longitudinal wires in end portions of each C-shaped member and in end portions of each straight member are parallel and more closely spaced than in the remainder of the member.

13. A reinforcing cage for a cast concrete structure as set forth in claim 8 wherein a transition bend portion of said reinforcing mats is free of longitudinal reinforcing wires.

14. A reinforcing cage for a cast concrete structure as set forth in claim 6 wherein said spacer member includes first and second elongated wires which are joined together by connecting wires.

15. A reinforcing cage for a cast concrete structure as set forth in claim 14 wherein said spacer member is substantially A-shaped.

16. A reinforcing cage for a cast concrete structure as set forth in claim 14 wherein said spacer member is substantially circular.

17. A reinforcing cage for a cast concrete structure as set forth in claim 14 wherein said spacer member is substantially rectangular.

18. A reinforcing cage for a cast concrete structure as set forth in claim 6 wherein each of said C-shaped members has an elongated side portion with bent end portions.

19. A reinforcing cage for a cast concrete structure as set forth in claim 18 wherein said end portions are substantially perpendicular to said side portion with a smoothly curved transition bend portion joining said side portions to each end portion.

20. A reinforcing cage for a cast concrete structure as set forth in claim 19 wherein each transition bend portion at each end of the C-shaped members is bent to the same dimensions.

21. A reinforcing cage for a cast concrete structure as set forth in claim 6 wherein end portions of said C-shaped members extend toward each other and ends of the straight members overlap the end portions of said C-shaped members.

22. A reinforcing cage for a cast concrete structure as set forth in claim 6 wherein said outer reinforcing cage, said inner reinforcing cage and said at least one spacer member are all attached together by wire ties.

23. A reinforcing cage for a cast concrete structure as set forth in claim 6 wherein said outer reinforcing cage, said inner reinforcing cage and said at least one spacer member are all welded together.

24. A reinforcing cage for a cast concrete structure as set forth in claim 6 wherein said reinforcing cage is rectangular.

25. A reinforcing cage for a cast concrete structure as set forth in claim 24 wherein a longitudinal tube is attached to the inside of each corner of said outer reinforcing cage.

26. A reinforcing cage for a concrete structure as set forth in claim 6 wherein said outer and inner reinforcing cages are substantially rectangular and at least one spacer is connected between opposed faces of each rectangular cage.

27. A reinforced concrete structure comprising:

a reinforcing cage including:

a plurality of longitudinal registration tubes at predetermined locations around said reinforcing cage;

an outer reinforcing cage surrounding each of said registration tubes;

an inner reinforcing cage substantially coaxially positioned relative to said outer reinforcing cage;

at least one separator fastened between said outer and said inner reinforcing cages for controllably separating said cages; and a cast concrete tube encapsulating said reinforcing cages in the walls thereof, said concrete tube having end surfaces substantially flush with the ends of said registration tubes exposing the ends of said registration tubes.

28. A reinforced concrete structure as set forth in claim 27 wherein said reinforcing cage is multi-sided and defines corners, and wherein said registration tubes are located at said corners.

29. A welded fabric concrete reinforcing mat comprising:

a welded steel fabric mat having a layer of first reinforcing wires connected to a transverse layer of second reinforcing wires, said second reinforcing wires being variably spaced across the length of said first reinforcing wires, said spacing including:

a first zone including a plurality of closely spaced reinforcing wires near each end of said first reinforcing wires;

a second zone adjacent each of said first zones free of reinforcing wires;

a third zone adjacent each of said second zones defined by a pair of non-uniformly spaced second reinforcing wires; and a fourth zone bounded by each of said third zones including a plurality of uniformly spaced reinforcing wires, said first reinforcing wires being bent in the same direction in said second zone, of said second reinforcing wires, to position the wires of said first zone at substantially a right angle to the wires of said fourth zone.

30. A welded fabric concrete reinforcing mat as set forth in claim 29 wherein each of said second reinforcing wires is smaller in diameter than said first reinforcing wires.

31. A welded fabric concrete reinforcing mat as set forth in claim 29 wherein said second zone is bounded by a reinforcing wire from said first and said third zones and the space between said bounding wires is wider than the spacing between wires in said first zones and said third zones.

32. A welded fabric concrete reinforcing mat as set forth in claim 29 wherein the bent portions of each of said first reinforcing wires are free of second reinforcing wires.

33. A welded fabric concrete reinforcing mat as set forth in claim 29 wherein said second reinforcing wires are on a same side of said first reinforcing wires as the bends in said first reinforcing wires.

34. A welded fabric concrete reinforcing mat as set forth in claim 29 wherein said second reinforcing wires are on the side included within the bent end portions of said first reinforcing wires.

35. A welded fabric concrete reinforcing mat as set forth in claim 29 wherein when said first reinforcing wires are bent in said second zone close to said first zone the thickness of an outer cover of concrete on the end portions of first reinforcing wires will be reduced.

36. A welded fabric concrete reinforcing mat as set forth in claim 29 wherein when said first reinforcing wires are bent in said second zone close to said third zone the thickness of an outer cover of concrete on the end portions of said first reinforcing wires will be increased.

37. A reinforcing cage having a plurality of connected support surfaces for inclusion in a cast concrete structure comprising:

an outer reinforcing cage including two C-shaped members joined by overlapped straight members;

an inner reinforcing cage coaxial with said outer reinforcing cage and spaced from said outer cage, said inner reinforcing cage including two C-shaped members joined by overlapped straight members;

at least one separator member between said outer and inner reinforcing cages for separating said cages; and a plurality of spaced longitudinal tubes defining the extremity of each support surface of said reinforcing cage.

38. A reinforcing cage assembly for a cast structure including a wall with opposing end faces, comprising:

a plurality of spaced longitudinal tubes having tubular end sections defining openings, said tubular end sections being threaded internally; and a reinforcing cage defining ends for positioning proximate the opposing end faces on the cast structure, said reinforcement cage comprising a matrix of reinforcement wires secured to said plurality of spaced longitudinal tubes, said longitudinal tubes being located on said reinforcing cage proximate said cage ends so that said tubular end sections are located proximate the opposing end faces of said cast structure, said openings in said tubular end sections forming a locator on the opposing end faces of said reinforcing cage so that said openings are accessible longitudinally for locating said reinforcing cage during manufacture of said cast structure.

39. A reinforcing cage assembly as set forth in claim 38 wherein said plurality of spaced longitudinal tubes extend fully between the opposing end faces.

40. A reinforcing cage assembly as set forth in claim 38 wherein said reinforcing cage defines a tubular shape including an inner passageway.

41. A reinforcing cage assembly as set forth in claim 40 wherein said reinforcing cage defines a rectangular shape.

42. A reinforcing cage assembly as set forth in claim 38 wherein said tubular end sections define guides configured to locate said reinforcing cage in a mold cavity having the shape of said cast structure.

43. A reinforcing cage assembly as set forth in claim 38 wherein said reinforcing cage includes an inner matrix of reinforcement wires and an outer matrix of reinforcement wires attached to said plurality of tubes with said tubes being located between said inner and outer matrixes.

44. A reinforcing cage assembly for a cast structure including a wall with opposing end faces, comprising:

a plurality of spaced longitudinal tubes having tubular end sections defining openings;

a reinforcing cage defining ends for positioning proximate the opposing end faces on the cast structure, said reinforcement cage comprising a matrix of reinforcement wires secured to said plurality of spaced longitudinal tubes, said longitudinal tubes being located on said reinforcing cage proximate said cage ends so that said tubular end sections are located proximate the opposing end faces of said cast structure, said openings in said tubular end sections forming a locator on the opposing end faces of said reinforcing cage, so that said openings are accessible longitudinally for locating said reinforcing cage during manufacture of said cast structure; and said tubular end sections defining guides configured to locate said reinforcing cage in a mold cavity having the shape of said cast structure, said tubular end sections including threads for interconnecting the cast structure to another cast structure.

* * * * *

UNITED STATES PATENT AND TRADEMARK OFFICE

CERTIFICATE OF CORRECTION

PATENT NO. : 5,487,251
DATED : January 30, 1996
INVENTOR(S) : Wilbur E. Tolliver et al.

It is certified that error appears in the above-indentified patent and that said Letters Patent is hereby corrected as shown below:

Column 4, Line 36;

"ben" should be –bent–.

Signed and Sealed this

First Day of October, 1996

*Attest:*

*Attesting Officer*

BRUCE LEHMAN

*Commissioner of Patents and Trademarks*